United States Patent [19]

Szczesny et al.

[11] Patent Number: 4,621,885

[45] Date of Patent: Nov. 11, 1986

[54] RIBBON CABLE CONNECTOR WITH IMPROVED COVER LATCH

[75] Inventors: David S. Szczesny, Harrisburg; John A. Root, Middletown, both of Pa.

[73] Assignee: AMP Incorporated, Harrisburg, Pa.

[21] Appl. No.: 778,095

[22] Filed: Sep. 20, 1985

[51] Int. Cl.[4] ..... H01R 13/62

[52] U.S. Cl. ..... 339/91 R; 339/99 R

[58] Field of Search ..... 339/91 R, 97 R, 97 P, 339/98, 99 R, 103 M, 17 F, 176 MF

[56] References Cited

U.S. PATENT DOCUMENTS

| | | | |
|---|---|---|---|
| 4,188,083 | 2/1980 | Knowles | 339/99 R |
| 4,431,248 | 2/1984 | Huntley et al. | 339/99 R |
| 4,452,501 | 6/1984 | Knowles | 339/97 R |

FOREIGN PATENT DOCUMENTS

| | | | |
|---|---|---|---|
| 2358895 | 6/1974 | Fed. Rep. of Germany | 339/91 R |

OTHER PUBLICATIONS

"Connector Retention and Polarizing Clip", IBM Bulletin, vol. 28, No. 5, Oct. 1985.

"Spring Retainer", IBM Bulletin, vol. 16, No. 12, May 1974.

*Primary Examiner*—Gil Weidenfeld

*Assistant Examiner*—Gary F. Paumen

*Attorney, Agent, or Firm*—F. Brice Faller; Bruce J. Wolstoncroft

[57] ABSTRACT

Ribbon cable connector has stamped and formed metal latch members fixed to cover at opposite ends thereof. Each latch member is U-shaped, having first and second latch arms and a formed bight therebetween. The first arm has stamped apertures cooperable with detents on the end of the connector housing at two positions. The second arm at its distal end is formed with an outwardly directed hook cooperable with a complementary connector.

6 Claims, 4 Drawing Figures

RIBBON CABLE CONNECTOR WITH IMPROVED COVER LATCH

BACKGROUND OF THE INVENTION

The present invention relates to a dual position latch for preassembling the cover to the housing of a ribbon cable connector, and further for retaining a complementary connector.

U.S. Pat. No. 4,359,257 discloses a ribbon cable connector of the type comprising an elongate housing with insulation displacing contacts projecting from the top surface thereof and an elongate cover having aperture means therein for receiving the contacts. Latch means at opposite ends of the connector fix the cover in first and second latched positions relative to the housing, the cover being spaced from the top surface in the first position to permit alignment of the cable for termination. The cover is movable from the first position toward the top surface to terminate the cable, the cover securing the cable in a terminated condition at the second position.

The connector as described above employs a pair of parallel latch arms molded integrally with the cover at opposite ends thereof. Detents on each latch cooperate with a yoke on the housing at the first position, and each latch arm is U-shaped to snap over a detent on the housing at the second position. A similar arrangement employing detents only on the latch arms is disclosed in U.S. Pat. No. 4,496,207.

The above described arrangement is satisfactory for achieving a "pre-assembled" connector which facilitates handling and ease in aligning a ribbon cable for termination. Any latching to a complementary connector has heretofore been achieved by discrete latching members. In particular, when the complementary connector is a header fixed to a printed circuit board, resilient latch arms are provided on the header. However, the advent of surface mount technology has necessitated the use of more brittle plastics which will withstand soldering temperatures. It is thus desirable to fix the resilient latch arms to the ribbon cable connector.

SUMMARY OF THE INVENTION

According to the invention, therefore, a ribbon cable connector as described above is characterized in that the latch means comprises a pair of stamped and formed metal latch members fixed to the cover at respective opposite ends thereof. Each latch member has a first latch arm cooperable with the respective end of the housing to effect latching at the first and second positions and a second latch arm adjacent the first latch arm and spaced from the housing. The second latch arm cooperates with a complementary connector to retain the ribbon cable connector thereto.

Not only do the latch arms combine several latching functions, but the use of spring metal makes the latch arms less subject to damage than the plastic heretofore used. While U.S. Pat. No. 4,431,248 discloses metal latch arms fixed in a housing to achieve preassembly of a cover, the additional function of providing retention to a complementary connector is not suggested.

DETAILED DESCRIPTION OF THE PREFERRED EMBODIMENT

Figure 1:
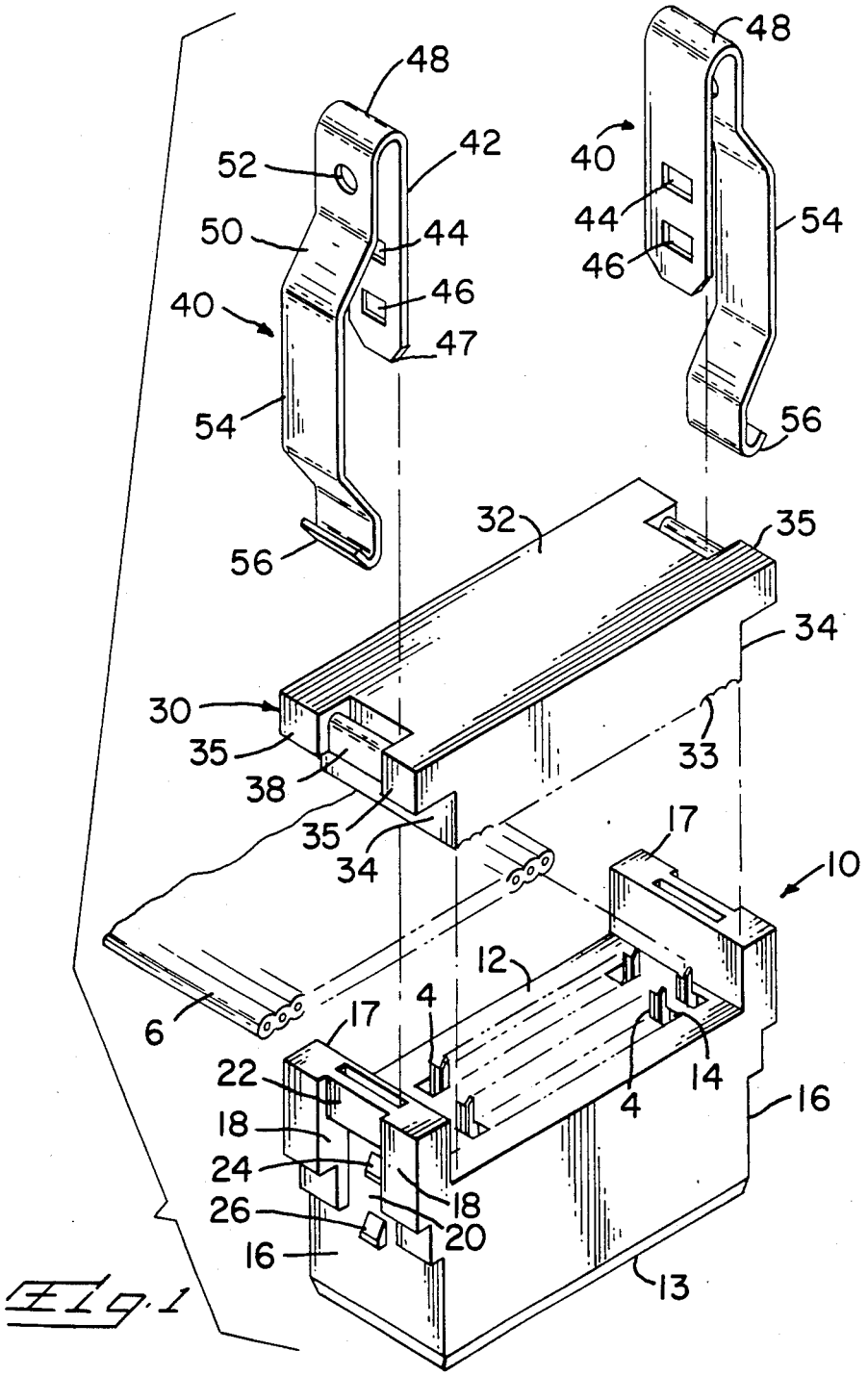
FIG. 1 is an exploded perspective of the connector.

Referring to FIG. 1, the connector comprises a molded dielectric housing 10 having a top surface 12, an opposed bottom surface 13, and a plurality of contact receiving passages 14 extending therebetween, the slotted plate portions of contacts 4 extending above surface 12. The housing 10 has opposed endwalls 16 with upstanding portions 17 flanking the surface 12 therebetween. Each endwall 16 has parallel sidewalls 18 thereon defining a channel 20 therebetween and a web 22 extending between sidewalls 18 on the upstanding portion 17. First and second detents 24, 26 lie in channel 20 and serve a latching function as will be described. The cover 30 has a top surface 32, a fluted bottom surface 33, and opposed ends 34. Each end 34 has a pair of extensions 35 thereon defining a channel 36 therebetween, and a web 38 bridging between the extensions. The latch member 40 is stamped and formed from spring metal such as stainless steel and comprises first and second latch arms 42, 50, connected by a bight 48 to yield a generally U-shaped profile. The first latch arm 42 has first and second apertures 44, 46 punched therethrough between the bight 48 and distal end 47. The second latch arm 50 has an outwardly formed hook 56 at its distal end and a bow 54 formed between the bight 48 and hook 56. A round hole 52 punched in arm 50 near bight 48 serves to retain a wire strain relief clip.

Figure 2:
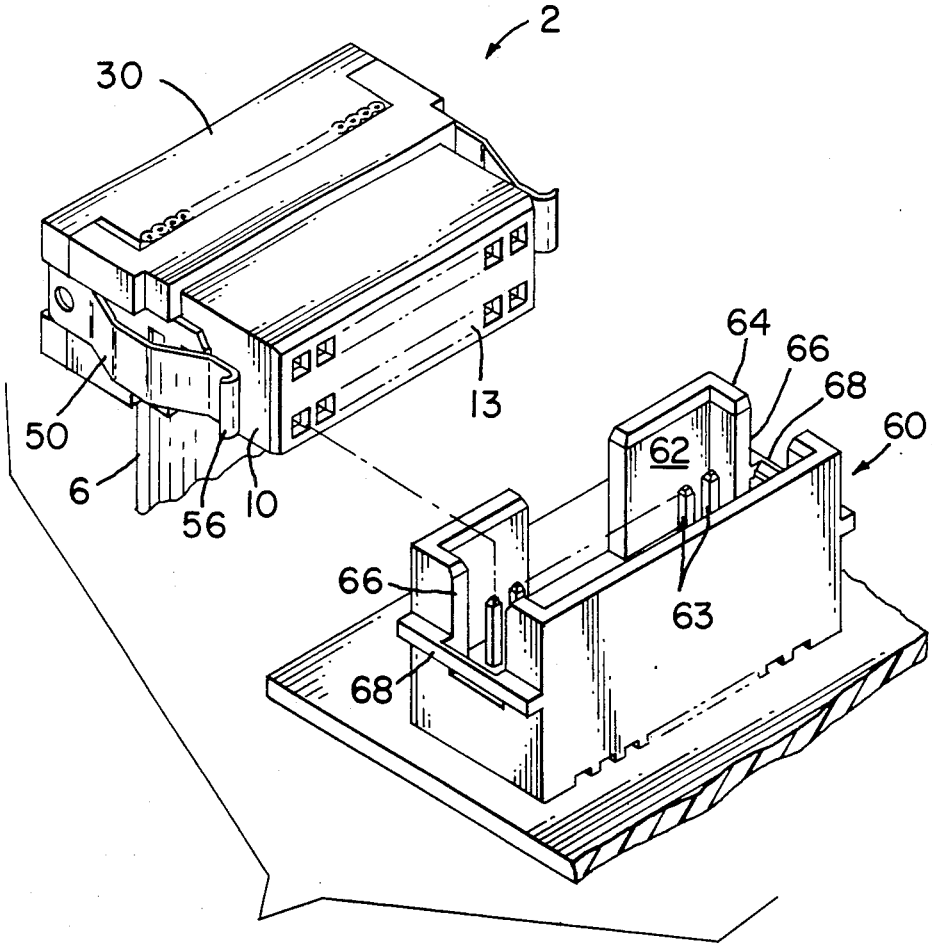
FIG. 2 is a perspective of the assembled connector exploded from a complementary connector.

Referring to FIG. 2, the assembled connector 2 is shown terminated to a ribbon cable 6, ready for mating to a pin header 60. The header 60 comprises a cavity 62 with an array of pins 63 therein, which pins 63 are received in bottom surface 13 of connector housing 10. The cavity 62 is bounded by endwalls 64 having respective channels 66 therein, each channel 66 being bridged by a yoke 68. The channels 66 allow latch arms 50 to flex inward during mating until the hooks 56 engage respective yokes 68 to retain the connector 2 to header 60.

Figure 3:
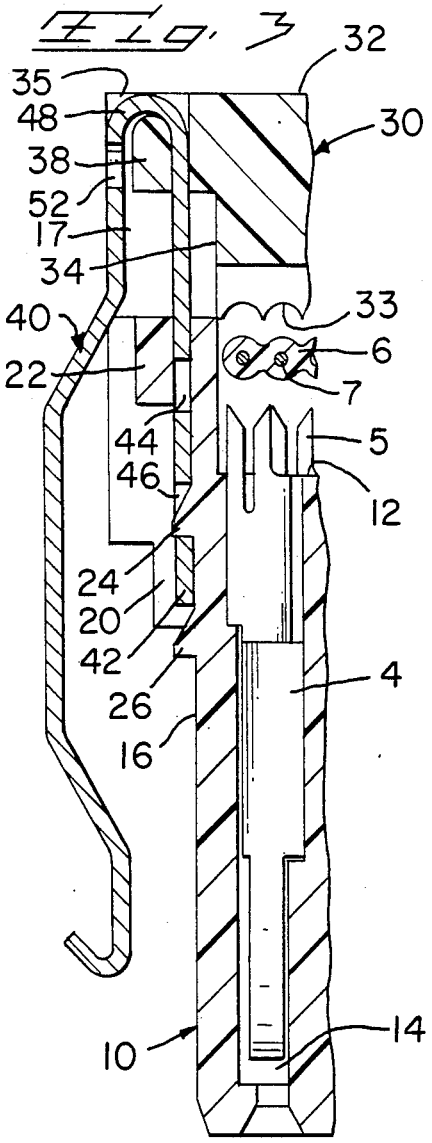
FIG. 3 is a partial side section of the preassembled connector.

FIG. 3 shows cover 30 preassembled to housing 10; here the lower or second aperture 46 in each first arm 42 is engaged with the upper or first detent 24 on the endwall 16. The latch member 40 is press fit into cover 30 between extensions 35 until the bight 48 rests on web 38. Arm 42 is closely received in channel 20 to provide lateral stability, while the fit of cover ends 34 between uprights 17 lends longitudinal stability. The web 22 between sidewalls 18 serves to increase the spring force necessary to deflect the arm 42 away from endwall 16.

To terminate a ribbon cable, the preassembled connector of FIG. 3 is placed upside down with the top surface 32 on an anvil. The ribbon cable is aligned on fluted bottom surface 33, and a press is brought to bear on bottom surface 13 of the housing 10. This advances top surface 12 downward so that slotted plates 5 engage individual conductors 1 in the cable. The first latch arms 42 flex away from adjacent endwalls 16 as the aperture 45 rides up the ramped upper surface of first detent 24; the arms 42 continue to flex until first aperture 44 engages first detent 24 and second aperture 46 engages second detent 26, as shown in FIG. 4.

Figure 4:
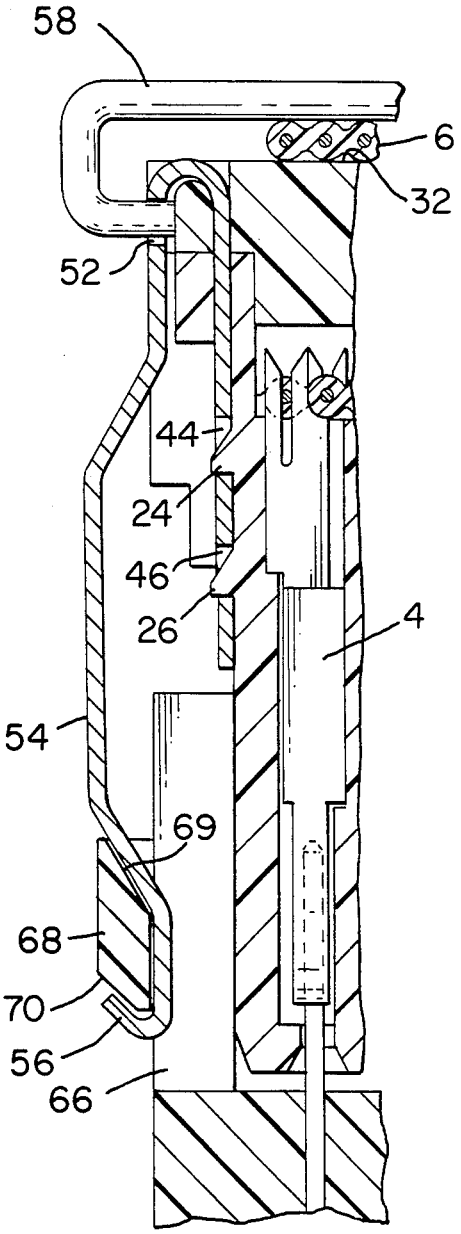
FIG. 4 is a partial side section of the assembled connector latched to a complementary connector.

FIG. 4 depicts a fully assembled connector 2, also shown in FIG. 2, as mated to pin header 60. The hook 56 is formed to ride against ramped upper surface 69 of yoke 68 during mating. To release the connector 2, the bowed portions 54 at opposite ends are depressed so that the hooks 56 ride against ramped lower surfaces 70 of yokes 68 until the hooks 56 snap off of respective yokes. An optional strain relief wire 58, used to clamp the ribbon cable against top surface 32, is shown hooked in punched hole 52.

The foregoing is exemplary and not intended to limit the scope of the claims which follow.

We claim:

1. A ribbon cable connector of the type comprising an elongate housing with insulation displacing contacts projecting from the top surface thereof, an elongate cover having aperture means therein for receiving said contacts, and latch means at opposite ends of the connector effective to fix said cover in first and second latched positions relative to said housing, said cover being spaced from said top surface in said first position to permit alignment of said cable for termination, said cover being movable from said first position toward said top surface to terminate said cable, said cover securing said cable in a terminated condition at said second position, characterized in that said latch means comprises a pair of stamped and formed metal latch members fixed to the cover at respective opposite ends thereof, each latch member having a first latch arm cooperable with the respective end of the housing to effect latching at said first and second positions, each latch member further comprising a second latch arm adjacent said first latch arm and spaced from said housing, said second latch arm being cooperable with a complementary connector to retain said ribbon cable connector thereto.

2. A ribbon cable connector as in claim 1 wherein each latch member is formed with a bight where the metal is formed through about one hundred eighty degrees between said first and second latch arms, said cover at each end being molded with a pair of extensions and a web extending transversely therebetween, said latch members being received in a press fit in said cover with each bight on a respective web.

3. A ribbon cable connector as in claim 1 wherein each first latch arm is stamped with first and second apertures along its length, said second aperture being most remote from said cover, said housing being formed with first and second detents at each end thereof, said second detent being most remote from said top surface, said first arms being loaded against respective ends of said housing, said first detents being received in respective second apertures at said first position, said first detents being received in said first apertures at said second position.

4. A ribbon cable connector as in claim 1 wherein each second latch arm has an outwardly formed hook remote from said cover, said complementary connector being molded with a web at each end, each hook latching to a respective web when the ribbon cable connector is mated to the complementary connector.

5. A ribbon cable connector as in claim 4 wherein each second latch arm is formed with a bow between the cover and the hook, each bow being depressed toward the housing to release the hook from the respective web on the complementary connector.

6. A ribbon cable connector as in claim 1 wherein said second latch arms are stamped with holes adjacent said cover, said holes serving to anchor a wire strain relief clip for holding the ribbon cable against the cover.

* * * * *